United States Patent [19]

Rosenhagen et al.

[11] 4,334,221

[45] Jun. 8, 1982

[54] MULTI-VEHICLE MULTI-CONTROLLER RADIO REMOTE CONTROL SYSTEM

[75] Inventors: William Rosenhagen, Ossining; George J. Whalen, New Rochelle, both of N.Y.

[73] Assignee: Ideal Toy Corporation, Hollis, N.Y.

[21] Appl. No.: 86,873

[22] Filed: Oct. 22, 1979

[51] Int. Cl.[3] ..... H04B 7/00; A63H 30/04

[52] U.S. Cl. ..... 340/825.72; 340/696; 340/825.69; 273/86 B; 180/167; 46/254

[58] Field of Search ..... 340/694, 695, 696, 164 B, 340/53, 62; 46/253, 251, 252, 254, 262; 455/39, 66, 67, 68, 70, 95, 186, 352, 345, 344; 180/2 R, 167; 273/86 B, 86 R

[56] References Cited

U.S. PATENT DOCUMENTS

| | | | |
|---|---|---|---|
| 3,400,488 | 9/1968 | Phillpott et al. | 180/2 |
| 3,482,046 | 12/1969 | Hughson et al. | 340/695 |
| 3,639,755 | 2/1972 | Wrege | 340/695 |
| 3,782,031 | 1/1974 | Byron | 46/262 |
| 4,080,602 | 3/1978 | Hattori et al. | 46/262 |
| 4,135,181 | 1/1979 | Bogacki et al. | 340/310 A |
| 4,171,468 | 10/1979 | Reiner | 340/695 |

*Primary Examiner*—John W. Caldwell, Sr.

*Assistant Examiner*—Donnie L. Crosland

*Attorney, Agent, or Firm*—Richard M. Rabkin

[57] ABSTRACT

A radio control system for a multi-controller, multi-vehicle, independently controlled toy vehicle system provides proportional steering and speed control without mutual interference. Each of a plurality of control sets repetitively transmits low-duty-cycle command bursts containing an identity code and steering and speed commands. The control sets transmit their command bursts asynchronously and, due to the low duty cycle of all transmissions, a high probability exists for non-inteference even when four or more control sets are simultaneously operated to control four or more toy vehicles. Each toy vehicle attempts to match any incoming command burst with a standard including an identity code unique to that vehicle. When a command burst is received which is correct in every respect, including the identity code, the steering and speed commands contained therein are stored and are executed until a new decodeable command burst is received. Command bursts which are not correct in every respect, due to noise or interference between control sets, are ignored and the previously stored commands continue to be executed.

8 Claims, 15 Drawing Figures

MULTI-VEHICLE MULTI-CONTROLLER RADIO REMOTE CONTROL SYSTEM

BACKGROUND OF THE INVENTION

The present invention relates to a toy vehicle control system in which a plurality of toy vehicles are independently controlled by a plurality of radio control sets without mutual interference therebetween.

Toy vehicle games are well known such as, for example, the "Slot car" game in which independent control of vehicle speed is provided to operators. In such games however the vehicle is constrained to a fixed predetermined and unvarying path.

In order to improve the play value of such vehicle games, "slotless car" games have been developed such as disclosed in, for example, U.S. Pat. Nos. 4,087,799 and 4,141,553. These "slotless car" games permit diversion of a toy vehicle from one lane into another as well as permitting control of the speed. However, the slotless car system is still limited to a track and depends for its steering on contact between the vehicles and one or the other side rails on the track.

Radio remote control systems have been developed for toy vehicles, such as, for example, toy aircraft, boats and rowing vehicles such as cars. However, such systems have been complex and expensive and are priced out of the usual toy market.

OBJECTS AND SUMMARY OF THE INVENTION

It is an object of the present invention to provide a control system for a toy vehicle which overcomes the limitations of the prior art.

More specifically, it is an object of the present invention to provide a control system for a toy vehicle which permits proportional control of steering and speed of a plurality of toy vehicles by a plurality of control sets without mutual interference therebetween.

Still another object of the present invention is to provide a control system for a toy vehicle which employs asynchronously transmitted command bursts from a plurality of control sets to a plurality of vehicles. The command bursts from each control set contain an identity code and each vehicle is capable of responding only to those command signals containing a unique identity code and which are correct in all other respects.

A still further object of the present invention is to provide a toy vehicle control system in which command burst signals are generated by a microprocessor in a control set and are decoded by a microprocessor in a vehicle.

A still further object of the present invention is to provide a control system for a toy vehicle in which command burst recognition and the generation of pulse width modulated control signals are time multiplexed.

Another object of the present invention is to provide a toy vehicle control system which is relatively simple and economical to manufacture.

According to an aspect of the invention, there is provided a vehicle radio control system of the type having a plurality of vehicles which are independently radio controlled by a plurality of radio sets comprising means in each of the control sets for repetitively generating radio frequency command bursts having a burst time and a burst period, the radio frequency command bursts being separated by quiescent periods at least ten times as long as the burst time, each of the control sets being associated with a different identity code, each of the vehicles being associated with an identity code of one of the control sets, means in the control sets for coding the command bursts with a predetermined code format containing at least the identity code and at least one function command, means in each of the plurality of vehicles for accepting the at least one function command only when it is associated with the identity code associated with the vehicle, the command bursts in the control sets being asynchronously generated whereby mutual overlap of control bursts from the plurality of control sets is reduced, and means in each of the plurality of vehicles for executing decoded command functions.

According to a feature of the invention, a vehicle radio control system is provided in which a control set repetitively transmits command bursts containing identity and function command data and a vehicle contains means for recognizing, storing and executing only command bursts containing the identity and function command data and for rejecting all other command bursts, the improvement comprising a method having the steps of: cycling the means for recognizing, storing and executing in repetitive cycles having a fixed length, estimating at the beginning of each of the cycles whether the executing requires more time than a predetermined portion of the fixed length, when the executing requires more than the predetermined portion, initiating the executing at the beginning of the cycle, performing the recognizing during the predetermined portion and terminating the executing after the end of the predetermined portion, and when the executing requires less than the predetermined portion, executing and terminating the executing within the predetermined portion and performing the recognizing from the end of the executing to the end of the fixed length.

According to a further feature of the invention, a vehicle radio control system is provided of the type having a plurality of vehicles which are independently controlled by a plurality of control sets comprising means in the plurality of control sets for generating a pulse-type radio frequency signal, a receiver in each of the plurality of vehicles for receiving the pulse-type radio frequency signal, means in each of the plurality of vehicles for recognizing a characteristic of a pulse-type radio frequency signal from the plurality of control sets, the receiver including: a regenerative stage, means for feeding the pulsetype radio frequency signal to the regenerative stage, means for developing a voltage in proportion to an amplitude of the pulse-type radio frequency signal fed to the regenerative stage, integrating means including a transistor and a feedback capacitor for integrating the voltage to produce an integrated voltage proportional to an average value of the voltage, means for feeding the integrated voltage back to the regenerative stage for controlling a quench frequency thereof, and the integrated voltage being an output of the receiver having an envelope proportional to an envelope of the pulse-type radio frequency signal.

According to a further feature of the invention, a vehicle radio control system is provided of the type having at least one control set in at least one vehicle, the control set being operative to transmit command signals to the at least one vehicle, comprising: means in the at least one vehicle for accepting, storing and repetitively executing the stored command signals and for alternately producing at least first and second function control signals, and gating means for preventing more than one of the at least first and second function control signals from being affective at any time.

The above, and other objects, features and advantages of the present invention will become apparent from the following description read in conjunction with the accompanying drawings in which like reference numerals designate the same elements.

DETAILED DESCRIPTION OF THE PREFERRED EMBODIMENT

Figure 1:
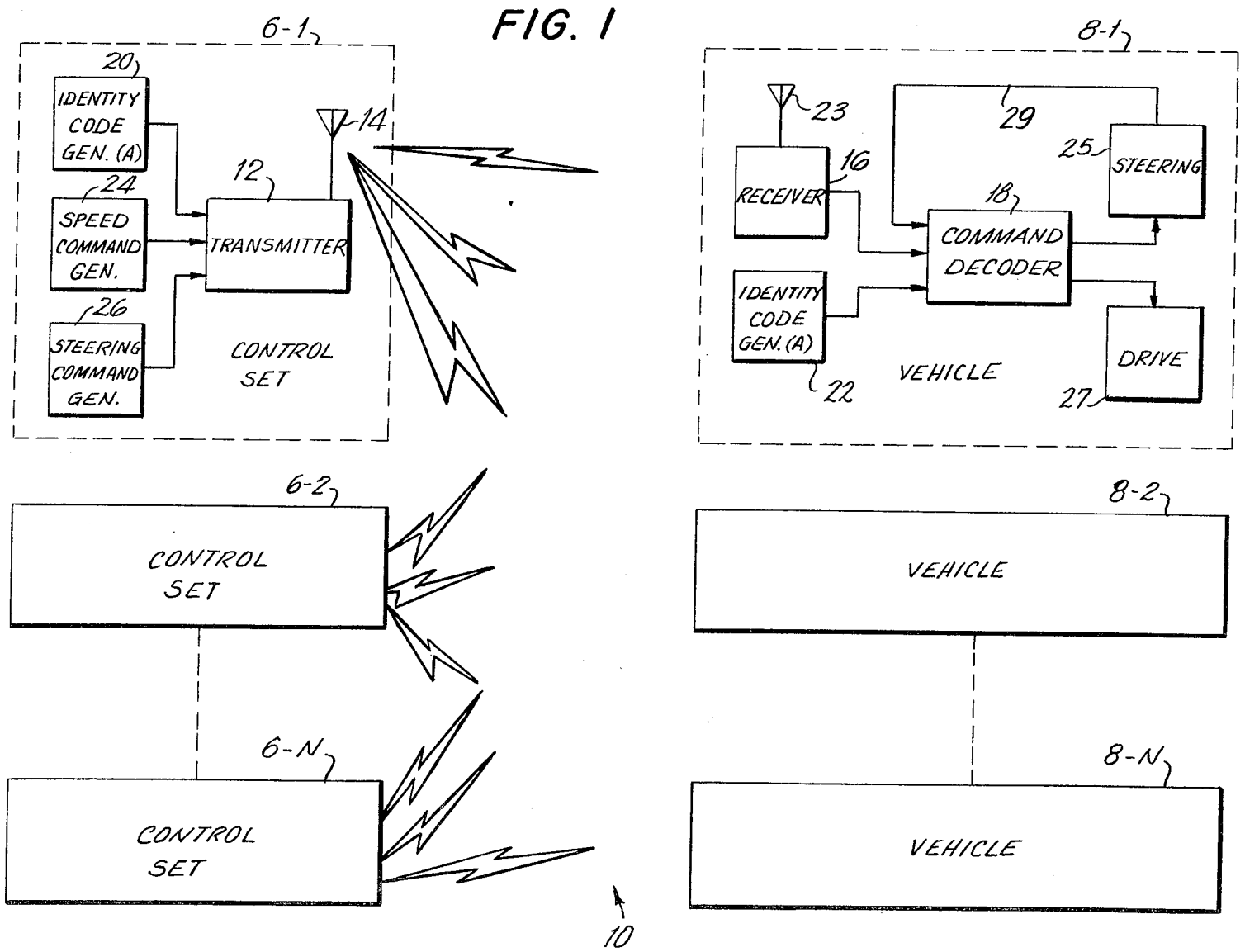
FIG. 1 is a system block diagram of a control system for a plurality of toy vehicles controlled by a plurality of control sets.

Referring now to FIG. 1, there is shown, generally at 10, a radio controlled racer system including a plurality of control sets 6-1 to 6-N which may be simultaneously energized to transmit command signals to a plurality of toy vehicles 8-1 to 8-N. Each control set, for example, control set 6-1, contains a transmitter 12, an identity code generator 20 providing a selectable identity code, such as for example, any one of identity codes A-M to transmitter 12, a speed command generator 24 and a steering command generator 26. Transmitter 12 repetitively transmits bursts of command signals containing identity, speed and steering data on antenna 14 which are received in all of the plurality of toy vehicles 8-1 to 8-N.

Each toy vehicle, for example, toy vehicle 8-1, contains a receiver 16 which is fed all received signals from an antenna 23 and which in turn feeds the demodulated signals to a command decoder 18. Command decoder 18 also receives an identity code, for example, code A, from an internal identity code generator 22. When a command burst received in receiver 16 and applied to command decoder 18 is correct in every particular, including the correct identity code matching the identity code provided by internal identity code generator 22, command decoder 18 stores the steering and speed signals and begins repetitively producing steering and drive pulse width modulated signals which it applies to a steering apparatus 25 and a drive apparatus 27.

Steering apparatus 25 generates a steering follow-up signal which it feeds back on a feedback line 29 to an input of command decoder 18. Command decoder 18 subtracts the steering follow-up signal from the stored steering command signal to derive a steering error signal representing the difference between the command steering position and the actual steering position which governs the width of the pulse width modulated signal fed to steering apparatus 25. A control system which employs such an error signal is known as a "closed-loop" control system.

The speed signal fed from command decoder 18 to drive apparatus 27 is also a pulse-width modulated signal which determines the speed at which toy vehicle 8 is driven. It will be seen in FIG. 1 that no feedback line is provided from drive apparatus to command decoder 18. A control system which responds directly to commands is known as an "open-loop" control system.

As noted in the preceding, command decoder 18 responds only to a command burst which is correct in every respect including an identity code identical to the identity code provided by identity code generator 22 in toy vehicle 8. Command bursts received from other control sets, for example, control sets 6-2 through 6-N are rejected by command decoder 18 which continues to execute the last properly decoded command burst it received. It is possible that a correct command burst, such as for example, a command burst containing the correct identity code A from control set 6-1 may arrive at about the same time that another command burst such as, for example, a command burst from control set 6-2 which contains an incorrect identity code. Such simultaneous arrival of command bursts may make it impossible for command decoder 18 to recognize the correct command burst transmitted by control set 6-1. In that case, command decoder 18 rejects the new command burst and continues to execute the last properly decoded command burst stored therein until a decodeable command burst is received.

Figure 2:
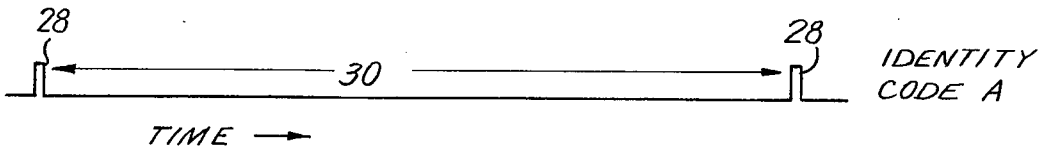
FIGS. 2 and 3 are waveform diagrams showing command burst spacing to which reference will be made in the description of the apparatus shown in FIG. 1.
Figure 3:
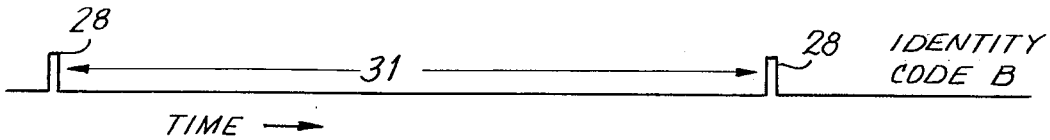

Referring now to FIGS. 2 and 3, there is shown the manner in which the command signals are transmitted in order to minimize interference therebetween. As seen in FIG. 2 an entire set of identity code, speed command and steering command signals is transmitted in a command burst 28 which is followed by a relatively long quiescent period 30 before the next command burst 28 is produced. If, for example, command burst 28 occupies about 2.5 milliseconds and the time between bursts occupies 97.5 milliseconds, there is only a 2.5 percent chance that a second randomly located command burst 2 from another control set falls within the burst period. Thus, two control sets, for example, 6-1 and 6-2 (FIG. 1) could be operated simultaneously with a small chance of interference. The duty ratio, or ratio of ON time to OFF time should be less than ten percent and preferably less than five percent. As previously noted, the command decoders reject all command bursts 28 which are not correct in every particular. If command bursts 28 from two control sets should occur at the same time, the overlapping command burst contains characteristics which cause both command bursts to be rejected by all command decoders. As long as the two interfering control sets do not have the same burst repetition frequency (the same quiescent period 30), even if two command bursts 28 were to occur at the same time, one or more quiescent periods 30 later, they are out of coincidence. Although it is highly unlikely that two independently operating transmitters could assume precisely the same burst repetition frequency and have their command bursts 28 aligned for a substantial period in time, if such an event should occur, a lengthy loss of control of both vehicles would result. To avoid such lengthly loss of control, each identity code selected in a control set causes the command bursts 28 to be produced at a slightly different burst repetition frequency. For example, in FIG. 2, identity code A produces a quiescent period 30 between command bursts 28 which is significantly longer than quiescent period 31 in FIG. 3 which results from identity code B. Thus, even when command bursts 28 in FIGS. 2 and 3 are momentarily aligned as shown to the left of FIGS. 2 and 3, lack of alignment on the next bursts 28 from each transmitter is guaranteed as shown by the rightmost bursts 28 in FIGS. 2 and 3. By making the burst periods relatively prime, minimum interference is achieved. For example, if burst periods of 77, 79, 83 and 89 milliseconds with burst lengths of 2.5 milliseconds are selected to correspond to four different identity codes, a burst overlap in a 4-vehicle system occurs only once every 4 seconds. Any particular toy vehicle experiences a burst overlap only about once every 10 seconds. Such interference is negligible.

Referring again to FIG. 1, command decoder 18 stores, and continues to execute, the last properly decoded command signals until the next properly decoded command burst occurs. Thus, when interference causes rejection of one or two command bursts, execution of the most recent command continues for one or more additional periods until the next properly decodable signal is received. By making the burst repetition frequency high enough, the loss of one or a few consecutive command bursts 28 has little or no noticeable effect on the performance of the controlled vehicle. In one embodiment reduced to practice, four different burst repetition frequencies from about 10 to about 13 bursts per second, dependent upon the selected one of four identity codes, with a burst period of about 2.5 milliseconds was found to give satisfactory performance when the steering and speed of four vehicles were independently controlled. Independent control of two functions (speed and steering) in four vehicles (a total of eight functions) is not a limit to the performance of a system according to the present invention. With the parameters detailed in the preceding, as many as 40 functions can be proportionately controlled before the rejection of command bursts due to mutual interference produce unacceptable response sluggishness. Thus more controlled functions per vehicle or more vehicles may be controlled. For example, two functions (speed and steering) can be controlled in up to 20 toy cars or four functions (roll, pitch, yaw and throttle) can be controlled in up to 10 aircraft without modification of the system. By changing the burst period, burst repetition frequency or burst content, more than 40 functions may be controllable without departing from the scope of the present invention.

Figure 4:
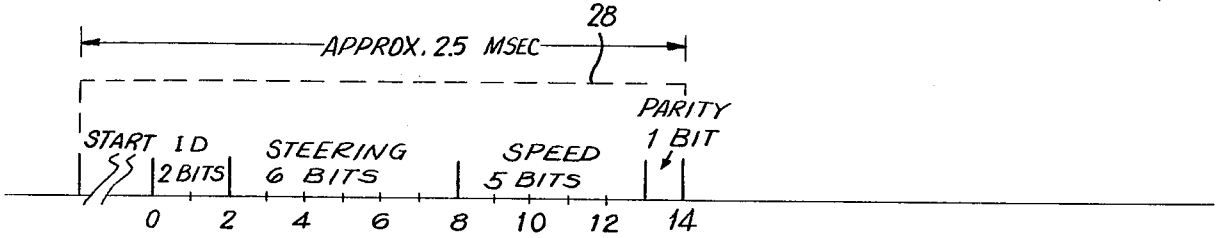
FIG. 4 shows the format of a command burst.

Command burst 28 can have any format capable of transmitting the required information including time, frequency, position and width coding, but in the preferred embodiment, digital coding in the format shown in FIG. 4 is employed. A start pulse, which may be slightly variable in length, initiates the sequence. The start pulse is followed by a 2-bit identity code, a 6-bit steering command, a 5-bit speed command and a single parity bit thus requiring 14 bits following the start signal. An entire command burst 28, including the start pulse, is transmitted in approximately 2.5 milliseconds.

Figure 5:
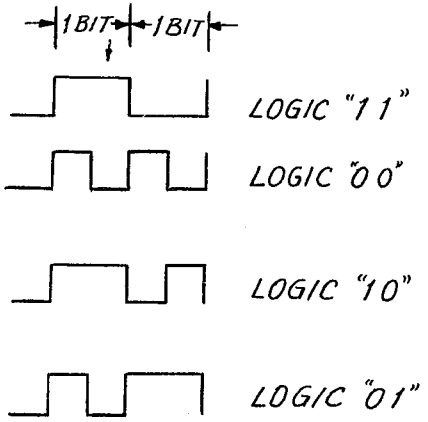
FIG. 5 shows Manchester digital coding.

In order to simplify processing, the digital bits employed in the code format of FIG. 4 are coded in "Manchester Code" as shown in FIG. 5. A logic "0" consists of a positive and a negative alternation in either order. A logic "1" employs a single positive or single negative alternation. If the preceding bit ended at a positive voltage, a logic "1" consists of a single negative alternation and vice versa. Similarly, the first half of a logic "0" is the inverse of the last half of a preceding bit. These relationships are illustrated in FIG. 5 for logic "11", "00", "10" and "01". The Manchester Code has the characteristic that both "0" and "1" represent a 50 percent duty cycle (ratio of ON time to total time) when even parity is used. Furthermore, recognition of logic "0" or "1" may be performed in a simplified manner using Manchester Code. As seen in FIG. 5, the first and second halves of a logic "1" have the same polarity whereas the first and second halves of a logic "0" have opposite polarities. Thus, upon detecting the leading edge of a bit, a window, indicated by a downward pointing arrow, is set in the second half of the bit. A comparison of polarities of the signal at the leading edge and at the window indicates whether the bit is logic "1" or "0".

Table 1 shows the equivalent decimal ranges available for the 2, 6 and 5 bits of the identity code, steering command and speed command signals. Specifically, the 2-bit identity code is capable of defining any one of four decimal numerals from 0 (defining identity code A) to 3 (defining identity code D).

TABLE 1

| COMMAND | NO. OF BITS | DECIMAL RANGE | NOMINAL DECIMAL RANGE USED | | |
|---|---|---|---|---|---|
| | | | MIN | CENTER | MAX |
| IDENTITY CODE | 2 | 0–3 | 0 CODE A | | 3 CODE D |
| STEERING | 6 | 0–63 | 16 FULL LEFT | 32 STRAIGHT | 48 FULL RIGHT |
| SPEED | 5 | 0–31 | 8 FULL FORWARD | 16 STOP | 24 RULL REVERSE |

The 6-bit steering command signal has 64 possible decimal values, however the nominal range employed is from 16 (full left) through 32 (straight ahead) to 48 (full right). As will be explained, any contiguous set of 32 decimal numerals within the 0 to 63 range may be employed. An automatic bias correction is generated in the command decoder to produce operation centered on decimal numeral 32. The 5-bit speed command signal has the ability to define 32 decimal digits from 0 to 31. Nominally the center 16 decimal digits from 8 (full forward) through 16 (stop) to 24 (full reverse) are used. In a manner similar to the steering command signal, any contiguous set of 16 numerals from 0 to 31 may be transmitted and an automatic bias correction system in the command decoder centers the operation on the numeral 16.

The parity bit (FIG. 4) provides an additional transmitted check signal which can be employed to reject a transmitted burst which contains errors due to noise, signal drop-out, faults in the transmitter, or interference. In general, all bits in the remainder of the burst are added and, the parity bit is made either "0" or "1" depending on the value of the least significant bit of the sum. When even parity is used, if the least significant bit of the sum is a "1", a "1" parity bit is appended to the burst in order that the sum of all bits in the command including the parity bit shall be "0" or even. Conversely, if odd parity is employed, under the same circumstances, a "0" would be appended as a parity bit. In the preferred embodiment, even parity is employed.

Figure 6:
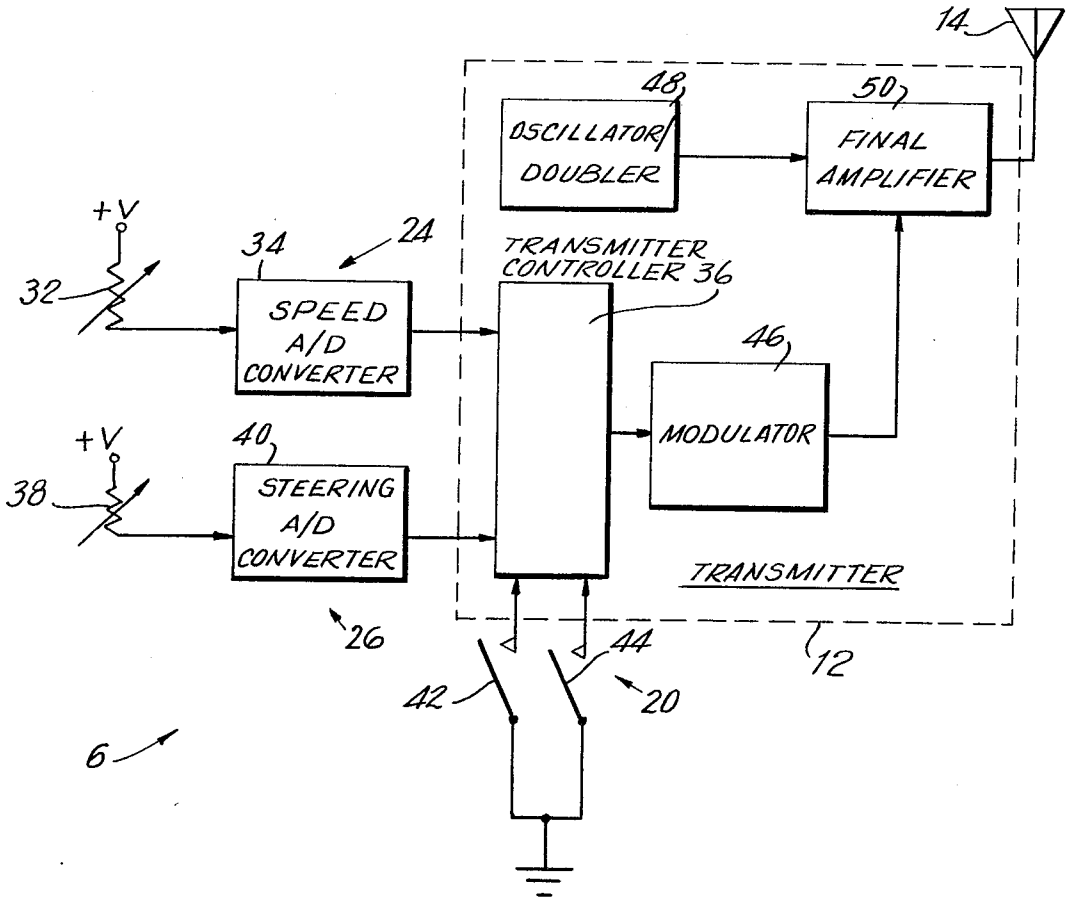
FIG. 6 shows a simplified block diagram of one of the control sets of FIG. 1.

Referring now to FIG. 6, there is shown a control set 6 for one of the vehicles. Since only one control set 6 is shown, the suffix numeral employed in FIG. 1 to identify specific control sets is omitted. Speed command generator 24 consists of a manually controllable speed variable resistor 32 between a voltage supply +V and an input of a speed A/D converter 34. Speed A/D converter 34 converts the analog signal at its input to a multi-bit digital number which is applied to an input of a transmitter controller 36. Similarly, steering command generator 26 includes a manually controllable steering variable resistor 38 connected between a voltage supply +V and an input of a steering A/D converter 40 which produces a multi-bit digital number which is applied to another input of transmitter controller 36.

Identity code generator 20 is optionally a pair of independently operable single-pole, single-throw, switches 42 and 44 each having one terminal connected to ground and the other terminal connected to an input of transmitter controller 36. When switch 42 or 44 is open, transmitter controller 36, sensing this condition at its input, interprets the corresponding bit of the identity code identified with that switch 42 or 44 to be "0". When a switch 42 or 44 is closed, transmitter controller 36 interprets this condition as a binary "1". Thus, by appropriately setting switches 42 and 44 in selected open and closed positions, any binary number from 00 to 11 (decimal 0 to decimal 3) can be applied to transmitter controller 36. If one or more additional switches (not shown) are employed in identity code generator 20, more identity codes can be defined for transmitter controller 36. Other techniques for providing an identity code to transmitter controller should be considered within the scope of the present invention. For example, a rotary switch (not shown) having four or more positions may be used and, in fact, this is the preferred embodiment. Each position of the rotary switch may provide a different combination of inputs to transmitter controller 36 corresponding to the desired identity code. Further, instead of applying either an open switch or a ground signal, a positive input may be combined with an open input to signify binary "0" and "1".

At appropriate times (see FIGS. 2 and 3) as established by the setting of identity code generator 20, transmitter controller 36 produces a command burst of "1" and "0" signals during approximately 2.5 milliseconds according to the signal format shown in FIG. 4. This command burst is applied to a modulator 46. An oscillator/doubler 48 in transmitter 12 may optionally generate any permitted transmitting frequency. In the preferred embodiment, a final transmitted frequency of about 49.86 MHz is employed. A free running oscillator oscillating at about 24.93 MHz has its frequency doubled in a doubler to produce a 49.86 MHz output signal from oscillator/doubler 48 which is applied to an input of a final amplifier 50. Final amplifier 50 either transmits or suppresses the radio frequency input from oscillator/doubler 48 depending on the condition of an output to modulator 46. Thus, the output of final amplifier 50 fed to antenna 14 contains the string of "0" and "1" digits comprising the command burst produced by transmitter controller 36.

Figure 7:
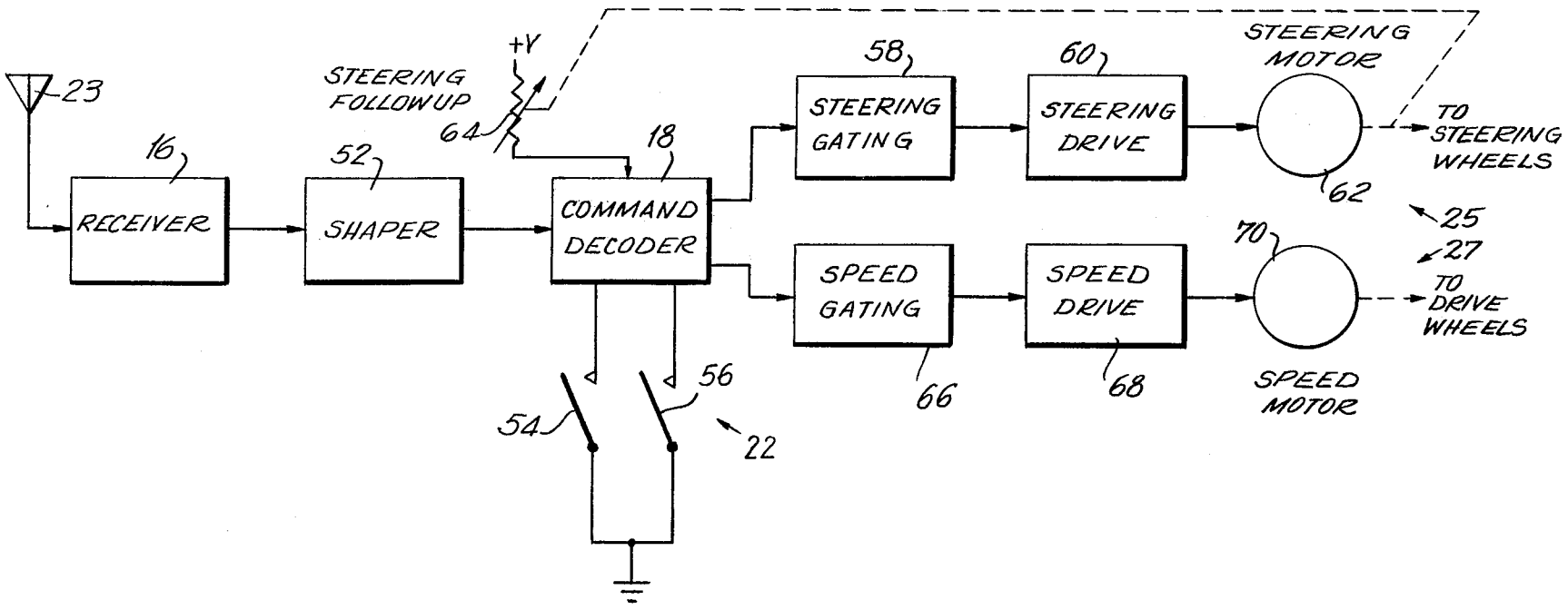
FIG. 7 is a simplified block diagram of a vehicle system of FIG. 1.

Referring now to the vehicle system shown in FIG. 7, command bursts received from all transmitters are coupled from antenna 23 to receiver 16. Receiver 16 is a special regenerative-type receiver whose operation will be explained hereinafter. Receiver 16 produces output pulses corresponding to the transmitted command bursts and applies the signals to a shaper 52 which sharpens the leading and trailing edges of the received signals for better processing. The shaped signals are applied to an input of command decoder 18.

Identity code generator 22 is seen to consist of a pair of single-pole, single-throw, switches 54 and 56 which function in a manner similar to switches 42 and 44 (FIG. 6) associated with control set 26 (FIG. 6). Therefore, a detailed description is omitted.

A pulse width modulated steering signal from command decoder 18 is applied to a steering gating circuit 58. An output from steering gating circuit 58 is applied to a steering drive circuit 60 which controls the application of the pulse width modulated signals to a steering motor 62. In response to the pulse width modulated input, steering motor 62 applies mechanical force to control the angle to which steering wheels, not shown, are turned to deflect them toward the left or the right. A signal proportional to the actual position of the steering wheels is fed back to the wiper of a steering follow up variable resistor 64 between a voltage source +V and an input to command decoder 18. Command decoder 18 compares the commanded steering position previously received from receiver 16 with the actual position from steering follow up variable resistor 64 and applies a signal representing only the error therebetween to steering gating circuit 58. Thus, as steering motor 62 drives the steering wheels (not shown) to the commanded position, the torque applied by steering motor 62 decreases until there is coincidence between the commanded and actual positions at which time no further steering torque is generated by steering motor 62. In fact, in the presence of equality between the commanded and actual steering positions, a brake signal is applied to steering motor 62 to damp out mechanical resonances and to resist inadvertent displacement of the steering wheels due to bumps, etc.

Steering gating circuit 58 is employed to ensure that only a unidirectional steering signal will be provided to steering motor 62. As will be explained, it is possible for command decoder 18 to momentarily provide steering signals commanding the steering wheels to turn both left and right as well as a brake signal. This may result in unnecessary stress and wear on steering motor 62 and unnecessary battery drain.

A pulse width modulated speed signal is applied from command decoder 18 to a speed gating circuit 66 having a function similar to the function of steering gating circuit 58. The pulse width modulated speed signal is applied to a speed drive circuit 68 which, in turn, applies the pulse width modulated speed signals to a speed drive motor 70. Speed drive motor 70 produces either a forward torque, a rearward torque or a braking torque according to the input from speed drive circuit 68. It will be noted that there is no signal fed back to command decoder 18 representative of the speed at which the drive wheels are rotated.

As is evident in FIG. 7, command decoder 18 must both attempt to recognize a proper input signal from receiver 16 as well as provide steering and speed pulse width modulated output signals. A pulse width modulated signal is a signal which has a ratio of ON time to total time which is proportional to the desired driving signal. For example, a speed pulse width modulated signal from command decoder 18 which is in the ON or driving condition 25 percent of the time, provides less energy to speed drive motor 70 than a speed signal which is ON or in the driving condition for 50 percent of the time. Pulse width modulated signals can have duty cycles, defined as the percent of time that they are in the ON condition, of from 0 percent (no driving signal) to 100 percent (full 100 percent drive). It is a characteristic of command decoder 18 according to the preferred embodiment that when command decoder 18 devotes its attention to the steering and speed output signals to choose the termination time of these signals it does so to the exclusion of the function of recognition and storage of new command signals. Thus, a time sharing technique is necessary between command recognition and storage and control of steering and speed to permit both recognition and execution of commands by a single command decoder 18. Accordingly, command decoder 18 operates on a fixed cycle time during which time is allocated for recognition and storage of an incoming command and for execution of stored commands.

Although any convenient cycle time may be selected, in the preferred embodiment, a cycle time of 50 milliseconds is employed. During the 50-millisecond period, one pulse is provided from command decoder 18 to speed drive motor 70 at the completion of which one pulse is provided to steering motor 62. The widths of the two pulses are proportional to the magnitudes of the respective command signals. As stated in the preceding, each pulse width modulated output of command decoder 18 is theoretically capable of assuming any duty cycle from 0 to 100 percent. In practice, however, the sum of the duty cycles of both steering and speed signals rarely, if ever, approach 100 percent. In addition, since a steering signal from command decoder 18 is only proportional to the steering error, this signal always tends toward zero pulse width. Consequently, the control outputs of command decoder 18 are normally dominated by the speed pulse width modulated control signal.

At the beginning of its 50 millisecond cycle, command decoder 18 contains stored steering and speed command signals previously acquired. Command decoder 18 first estimates the fraction of its 50 millisecond cycle which must be devoted to speed control. If the time required to initiate and terminate a speed pulse width modulated signal is less than 25 milliseconds (half the 50 millisecond cycle time), command decoder 18 immediately produces the speed pulse width modulated signal and follows it with the steering pulse width modulated signal. From the end of the steering pulse width modulated signal until the end of the 50 millisecond cycle time, command decoder 18 devotes its attention to attempting to recognize a command burst from receiver 16. Conversely, if, at the beginning of the cycle, command decoder 18 estimates that the time required to provide the speed pulse width modulated signal exceeds 25 milliseconds, it immediately sets an output which turns ON the speed signal to speed gating circuit 66 and then devotes the first 25 milliseconds of the cycle to attempting to recognize a command burst. At 25 milliseconds, command decoder 18 ceases attempting to recognize a command burst and begins monitoring for the end of the speed pulse width modulated signal. After this occurs, command decoder 18 produces the required steering pulse width modulated signal. Thus, when the duty cycle of the speed pulse width modulated signal is less than 50 percent, command burst recognition is performed after the control functions are completed, whereas when a speed duty cycle exceeding 50 percent, command burst recognition is attempted during the first half of the cycle. As will be evident from the preceding, at least 50 percent of each 50 millisecond cycle time is devoted to command burst recognition and thus an average of no more than 50 percent of decodeable command bursts 28 are lost due to time sharing of command decoder 18 between command burst recognition and control functions. Due to the relatively high rate of command burst transmission compared to the relatively sluggish mechanical response of the controlled vehicles, little or no degradation in control response results from such time sharing. Performance is enhanced by the fact that each properly decoded command is stored in command decoder 18 and continues to be executed until the next properly decoded command is received.

If a vehicle fails to receive a properly decodeable command signal in a predetermined period of time, suitably from about 0.5 to about 1.5 seconds, command decoder 18 produces a braking signal which brings toy vehicle 8 to a stop awaiting the receipt of a new command signal. This avoids toy vehicle 8 running away and becoming lost or damaged when the control signal is lost due to distance, malfunction or turning off control set 6.

Manufacturing tolerances in control set 6 are such that an error may exist in the speed and steering data included in command burst 28. To overcome such errors, when the apparatus in FIG. 7 is first turned ON and receives its first properly decoded command burst, command decoder 18 treats the first decoded command burst as if it contained zero speed and neutral steering commands. If the first commands received are other than zero speed and neutral steering, command decoder 18 generates and stores an offset numeral for the affected function which is then added to, or subtracted from, each subsequent command received. For example, as noted in Table 1, steering command numeral 32 is the nominal command for straight ahead, neutral steering. Full left and full right steering are nominally plus and minus 16 decimal numbers from 32 respectively. However, if the first steering command decimal numeral received is, for example, 27 (5 less than the nominal neutral steering command signal of 32), command decoder 18 stores a positive offset numeral 5 which it then adds to each subsequent steering command received. Thus, the apparatus in FIG. 7 is capable of responding to steering commands in the range of 11 to 43 which, when added to the decimal 5 offset stored in command decoder 18 provides the normal steering range of 16 to 48. In this way, a 32 digit range of decimal values anywhere within the decimal range 0 to 63 may be employed for steering. Similarly, any 16 decimal digit range within the 0 to 31 digit range of the speed control signal may be employed.

Figure 8:
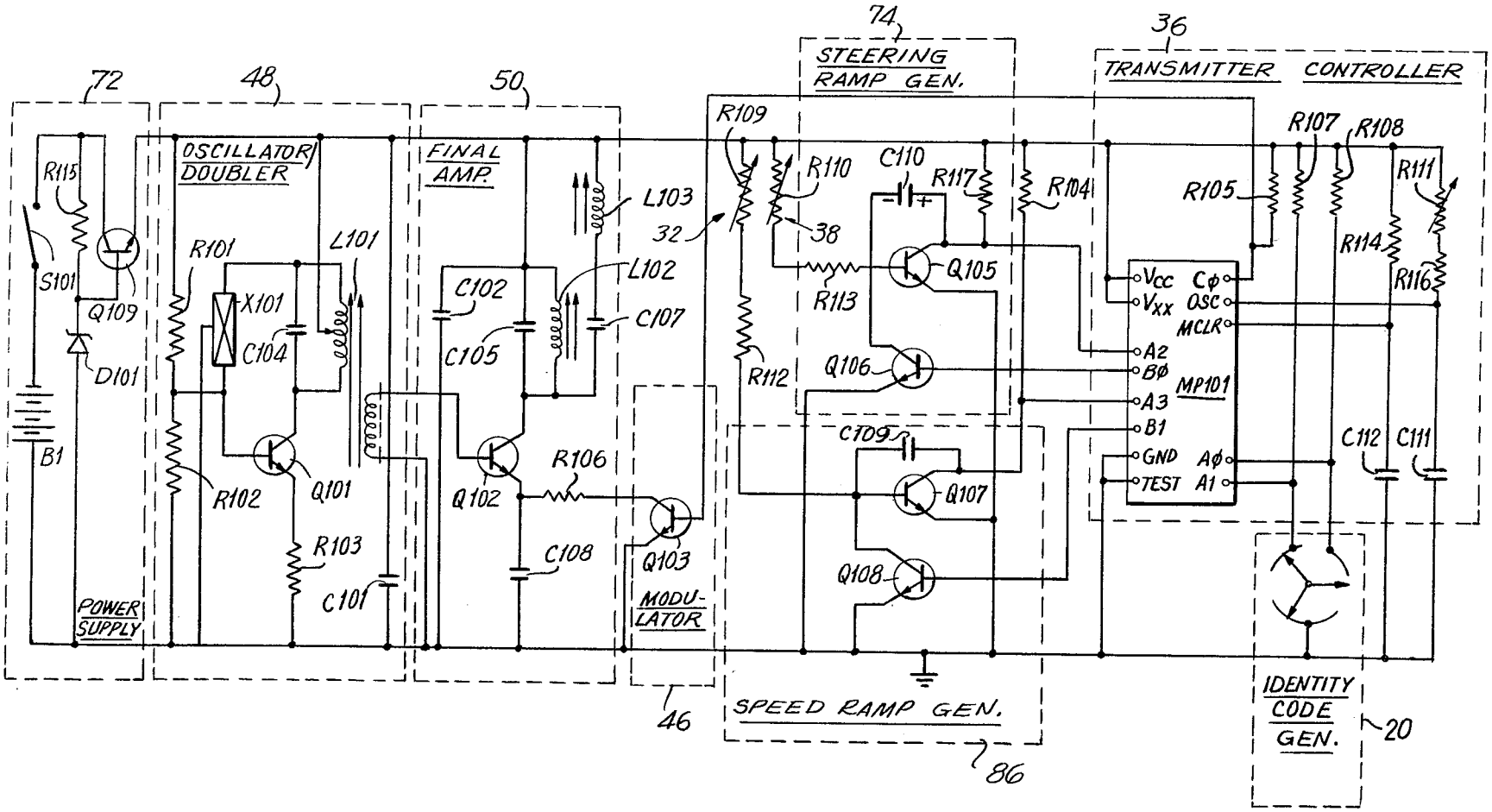
FIG. 8 is a detailed schematic diagram of a control set of FIGS. 1 and 6.

Referring now to the detailed schematic diagram of the control set 6 shown in FIG. 8, which corresponds to control set 6 in the block diagram shown in FIG. 6, and wherein like reference numerals refer to like components, a conventional series regulated power supply 72 regulates the DC voltage available from a battery B1 which may supply, for example, 9 volts DC through an ON-OFF switch S101 to the collector of a series regulating transistor Q109. Zener diode D101 controls the current through series regulating transistor Q109 to a value which maintains the voltage at the emitter of transistor Q109 at a substantially constant value.

Oscillator/doubler 48 is a conventional crystal oscillator employing an oscillator transistor Q101 and a parallel tuned tank circuit consisting of a capacitor C104 in parallel with an inductor L101. A 24.93 MHz oscillator crystal X101 controls the frequency of oscillation of the circuit. The oscillator tank circuit is tuned to the second harmonic of crystal X101 and thus couples out a frequency of 49.86 MHz to a secondary winding of inductor L101. The 49.86 MHz signal is applied to the base of a final amplifier transistor Q102 in final amplifier 50. A parallel tuned collector tuning circuit consisting of capacitor C105 and inductor L102 as well as a series tuned circuit consisting of a capacitor C107 in series with an inductor L103 enhance the amplification of the output frequency of 49.86 MHz and suppress the crystal fundamental frequency. The amplified signal is applied to antenna 14.

Modulator 46 includes a transistor Q103 having its emitter-collector path in series to ground from the emitter of transistor Q102 through a small value resistor R106. Control signals applied from transmitter controller 36 to the base of transistor Q103 in modulator 46 determine whether or not final amplifier transistor Q102 couples the signal at its base to antenna 14. Thus, the signal transmitted from antenna 14 is turned ON and OFF by the signal at the base of modulator transistor Q103.

Figure 9:
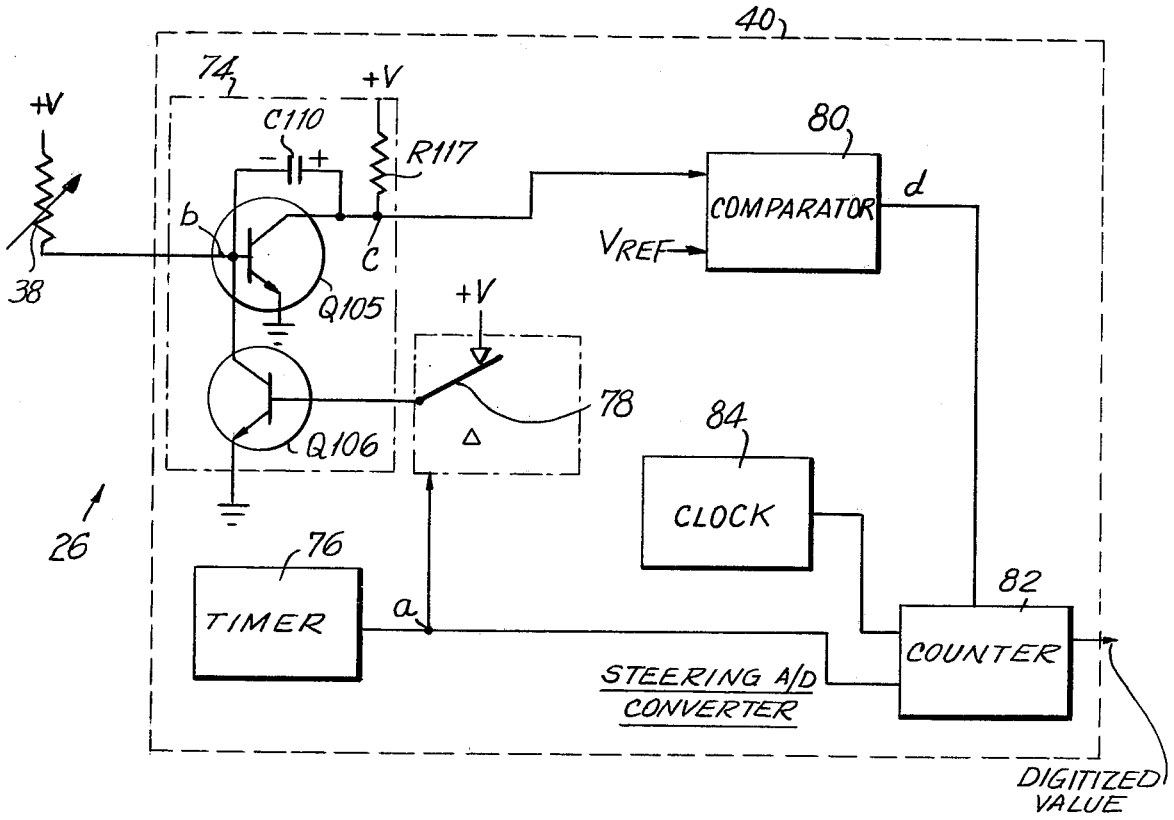
FIG. 9 is a simplied block and schematic diagram of a steering A/D converter of FIG. 6.
Figure 10:
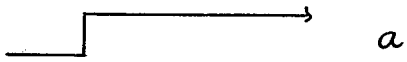
FIGS. 10–12 are waveform diagrams to which reference will be made in explaining the operation of the steering A/D converter of FIG. 9.
Figure 11:
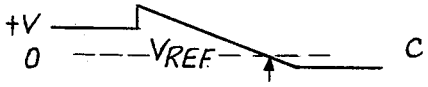
Figure 12:
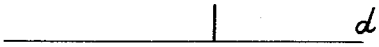

Referring momentarily to FIG. 9, it is seen that steering command generator 26 includes steering variable resistor 38 and steering A/D converter 40. Steering A/D converter 40 contains a steering ramp generator 74, a timer 76, a control switch 78, a comparator 80, a clock generator 84 and a triggerable counter 82. FIGS. 10–12 show signals in steering A/D converter 40 at appropriate times in the cycle.

Initially, control switch 78 is in the position shown wherein it connects a positive voltage +V to the base of switch transistor Q106. Q106 is thereby made conductive and connects point b at the base of linearizing transistor Q105 to ground. Capacitor C110 becomes fully charged with the polarities shown through resistor R117 to voltage +V.

Timer 76 applies a pulse a (FIG. 10) to control switch 78 to reverse the position thereof and to triggerable counter 82 to reset it and to initiate counting of clock pulses therein from clock generator 84.

Switch transistor Q106 is cut off, or made nonconductive, by the removal of the voltage +V from its base. Consequently, the ground reference previously applied to point b is removed. Thus, the voltage at points b and c rise to values determined by the setting of steering variable resistor 38 as shown in FIG. 11. The charge in capacitor C110 begins discharging both through resistors R117 and 38 as well as through the collector-emitter path of linearizing transistor Q105. As shown in FIG. 11, the voltage at point c begins to decay. Linearizing transistor Q105 initially conducts very little due to the initially low base bias caused by the charge stored in capacitor C110. As the discharge proceeds, the base bias of transistor Q105 increases generally inversely to the normal parabolic discharge rate of an RC discharge. Thus, linearizing transisting Q105 improves the linearity of voltage decay at point c.

Comparator 80 continuously compares the voltage at point c with a reference voltage $V_{REF}$, which may be any value and is represented in FIG. 11 by the horizontal dashed line. When the voltage at point c equals reference voltage $V_{REF}$, comparator 80 produces a trigger pulse d (FIG. 12) which is applied to triggerable counter 82 to stop the counting and store therein a digitized value whose magnitude is dependent upon the setting of steering variable resistor 38. Although steering A/D converter 40 may be fabricated of discrete components or of integrated circuits, in the preferred embodiment, all functions except those performed by steering ramp generator 74 are performed in a microprocessor MP101 (FIG. 8).

A speed ramp generator 86 cooperates with microprocessor MP101 in the same manner as steering ramp generator 74 to produce a digitized value which is dependent upon the setting of speed variable resistor 32. Steering A/D converter 40 and speed A/D converter 34 time share microprocessor MP101.

Identity code generator 20 is optionally shown as a rotary switch having four positions which are capable of generating the required four conditions on the two input lines $A_0$ and $A_1$ to microprocessor MP101.

Figure 13:
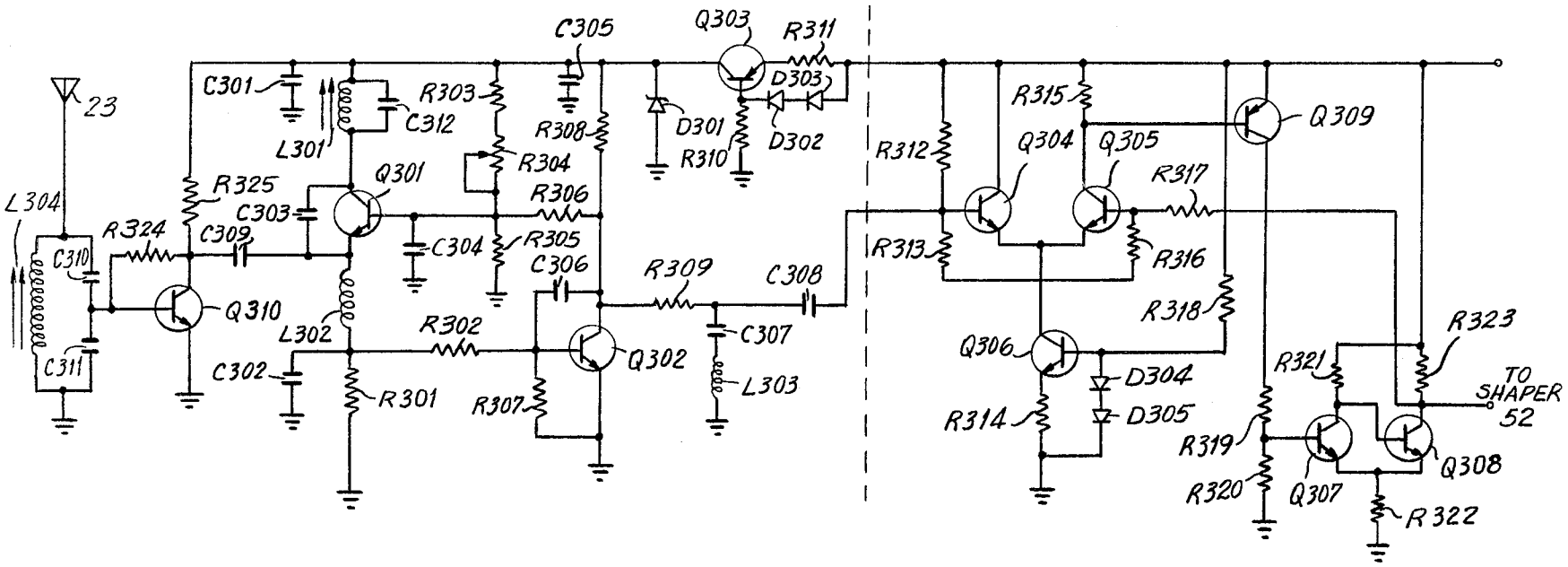
FIG. 13 is a detailed schematic diagram of a receiver of FIGS. 1 and 7.

Referring now to FIG. 13, there is shown a detailed schematic diagram of a receiver 16. A command burst received on antenna 23 is tuned in a receiver input circuit made up of inductor L304 and capacitors C310 and C311. The signal at the junction of capacitors C310 and C311 is applied to the base of an RF amplifier transistor Q310. The amplified radio frequency signal is applied through capacitor C309 to the emitter of regenerative transistor Q301. The radio frequency stage preceding regenerative transistor Q301 reduces interference which may be radiated by antenna 23.

Transistor Q301 is a grounded-base oscillator having its base held at RF ground by capacitor C304. A tank circuit, composed of inductor L301 in parallel with capacitor C312 is tuned to the transmitted frequency of 49.86 MHz. An inductor L302 in series with a resistor R301 in parallel with a capacitor C302 to ground from the emitter of transistor Q301 permits a feedback capacitor C303 to feed back a portion of the signal in the tank circuit to the emitter of transistor Q301. At some value of collector current, the gain of transistor Q301 exceeds unity thus permitting oscillations to occur which are sustained in the tank circuit.

Assume that initially receiver 16 is turned OFF. Capacitors C302 and C304 are discharged. When receiver 16 is turned ON, the base of transistor Q301 is initially at 0 volts and begins to rise as capacitor C304 charges. As capacitor C304 charges, the base voltage and collector current in transistor Q301 increase until the collector current reaches a value at which the gain of the transistor exceeds unity which thereupon causes the circuit to oscillate. This causes the collector current of transistor Q301 to increase very rapidly and results in a rapid voltage drop across emitter resistor R301. As the voltage across resistor R301 increases, this value, stored in capacitor C302, increases to a value which is more positive than the base of transistor Q301 thus cutting off the transistor. The voltage in capacitor C302 discharges through resistor R301 until it is sufficiently low to again allow conduction in transistor Q301. This cycle of oscillation and cut off occurs at a relatively rapid frequency of about 300 KHz. Amplification of the incoming signal is accomplished while the voltage across resistor R301 is rising and is strongest in a region just before transistor Q301 goes into full, strong oscillation. In this region, a condition of positive feedback exists which results in amplification of the incoming signal at high gain. Ordinarily, the effect of receiving an incoming signal in a regenerative receiver is an increase in the rate at which transistor Q301 goes into and out of oscillation. This rate is called the quench frequency. If nothing is done to prevent it, the quench frequency of about 300 KHz under no-signal conditions increases to about 400 or 500 KHz when a strong signal is received. This would cause the average voltage across emitter resistor R301 to increase with increasing received signal strength. The average voltage across resistor R301 is therefore representative of the envelope of the detected signal.

An integrating transistor Q302 receives the voltage across resistor R301. Transistor Q302 acts as a conventional operational amplifier with feedback capacitor C306 connected between its collector and base. The voltage stored in feedback capacitor C306 is essentially multiplied by the gain of transistor Q302 to increase the speed of response of the circuit.

The DC no-signal base bias of transistor Q301 is established by resistor R303, variable resistor R304, resistors R305, R306 and R308. Variable resistor R304 is initially adjusted for maximum gain. In the presence of a signal, the integrated voltage in capacitor C306 is fed back as a negative feedback signal to the base of regenerative transistor Q301 to prevent the normal increase in quench frequency. Thus, the quench frequency remains at about 300 KHz. The integrated signal envelope is recovered at the collector of Q302 rather than by filtering the signal across resistor R301. Thus, the speed of response of the receiver is increased by the loop gain of the system which is several hundred times as compared to normal integration and permits recovery of data information being transmitted at pulse widths of about 100 microseconds.

The recovered data signals are coupled through capacitor C308 to a differential amplifier consisting of transistors Q304 and Q305 with a constant current source transistor Q306 connected to their emitters. The differential amplifier with associated transistor Q309, Q307 and Q308 acts as a signal comparator having hysteresis to square up the data signal and to prevent retriggering by noise in the demodulated signal.

Voltage divider resistors R312 and R313 hold transistor Q304 fully ON in the no-signal condition. With transistor Q304 fully ON, the current through transistor Q305 is 0 and therefore there is no voltage drop across resistor R315. The absence of voltage drop across resistor R315 turns transistor Q309 OFF. With transistor Q309 OFF there is no base drive for transistor Q307 and therefore transistor Q308 is turned ON by the base current provided through resistor R321. The output signal to shaper 52 is therefore "O" under this condition.

When a negative pulse is received at the base of transistor Q304 (indicating the presence of a signal) transistor Q304 is turned OFF which turns transistor Q305 ON and develops a voltage drop across resistor R315. The voltage drop across R315 turns ON transistor Q309 which thus provides base drive voltage to transistor Q307. With transistor Q307 turned ON, the voltage drop across resistor R321 turns OFF transistor Q308 and produces a "1" for application to shaper 52.

Voltage divider resistors R317 and R318 apply a fraction of the positive voltage appearing at the collector of Q308 to the base of transistor Q305. This increase in voltage at the base of transistor Q305 thereupon requires an even greater positive voltage at the base of transistor Q304 before the system can again be triggered. This resulting latching voltage, which may be about 20 millivolts, is added to the original threshold level of about 80 millivolts to maintain the circuit in the latched condition against noise or other of minor changes in input signal level.

Figure 14A:
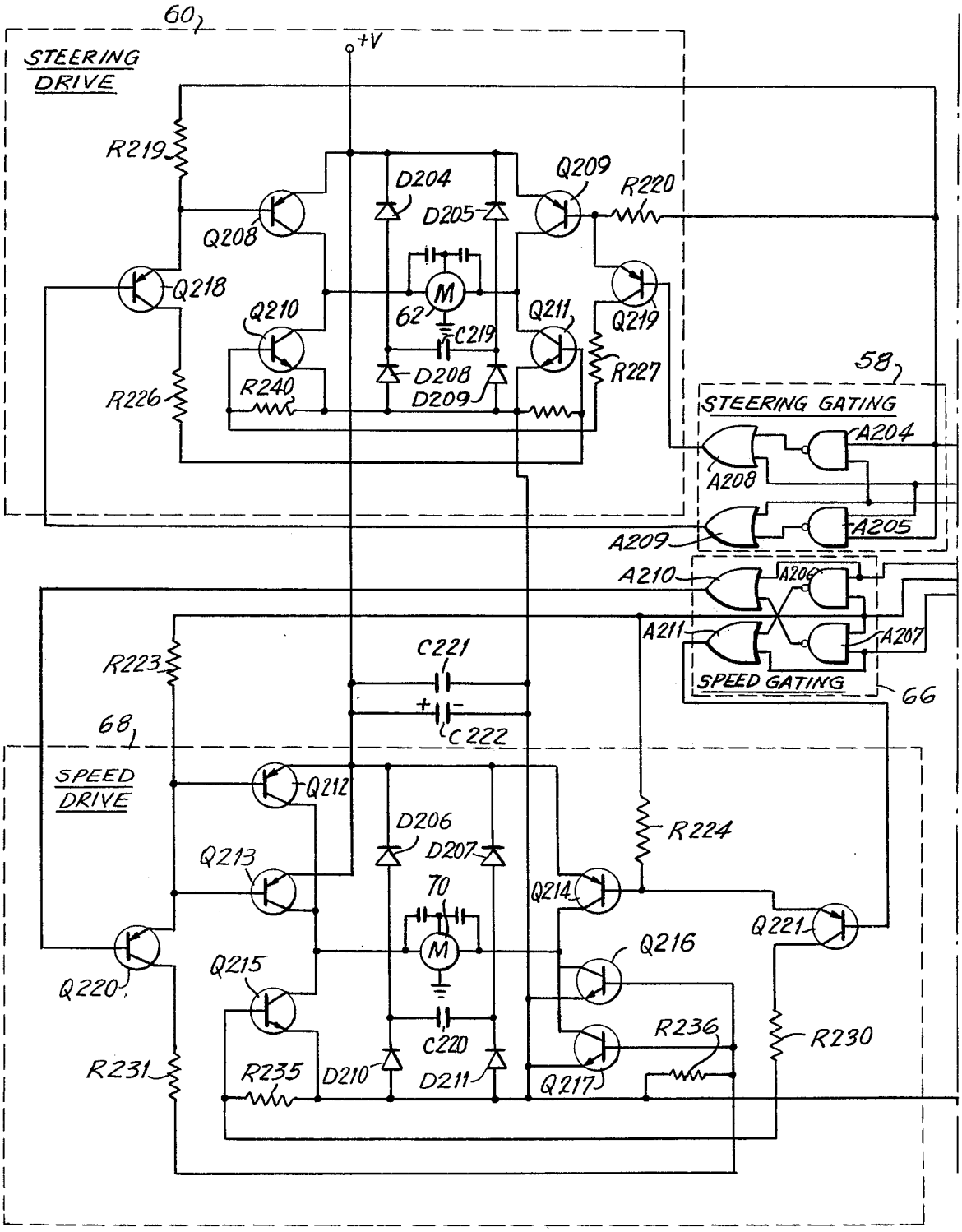
FIGS. 14A and 14B are a detailed schematic diagram of a vehicle system of FIGS. 1 and 7 not including the receiver.
Figure 14B:
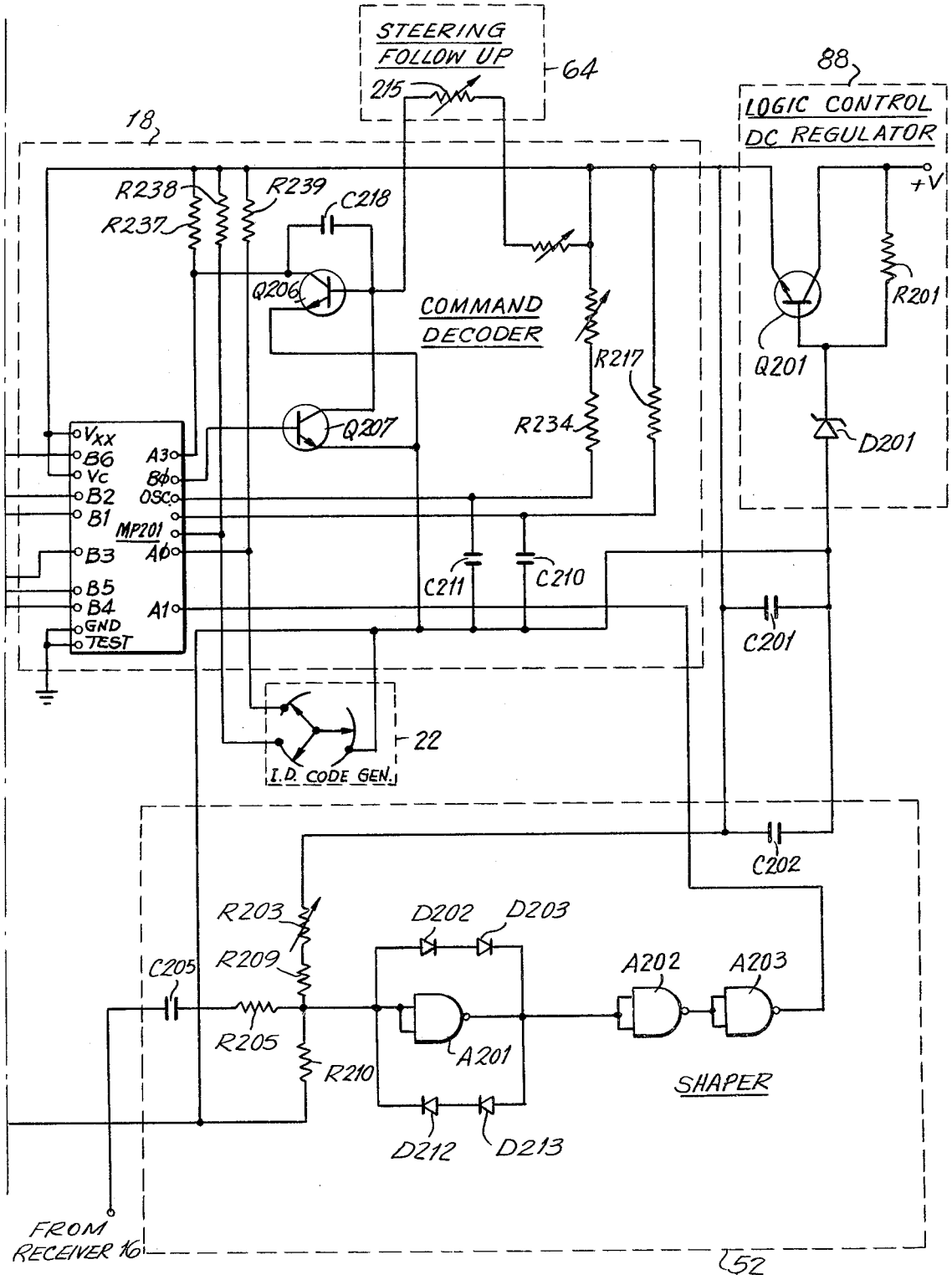

The signal from receiver 16 is coupled through capacitor C205 to shaper 52 (FIG. 14B). In shaper 52, the pulses are first amplified in an amplifier/limiter A201 where their positive peaks are clipped at about 1.4 volts by series pair of diodes D212 and D213 between output and input and their negative peaks are similarly clipped at about 1.4 volts by a series pair of diodes D202 and D203. The clipped pulses are amplified in inverters A202 and A203 to further steepen their rise and fall times and are applied to an input of a microprocessor MP201 in command decoder 18. Microprocessor MP201 attempts to recognize a correct command burst as previously described.

In the preferred embodiment, two sources of DC power are provided in toy vehicle 8. The first source (+V) is used for logic control and the second source (++V) is used for drive and steering. Partitioning of the power sources in this way permits relatively tight regulation of the DC power employed in logic control without placing unnecessary limitations on the relatively high current power sources required by steering motor 62 and speed drive motor 68. Thus, the drive systems are capable of operating with an unregulated battery source that can be isolated from the regulated logic DC source.

A logic control DC regulator 88 performs series regulation on DC input voltage +V using a series regulating transistor Q201 controlled by a Zener diode D201 and resistor R201. The regulated DC output of logic controller DC regulator 88 is employed in command decoder 18, shaper 52, steering gating circuit 58 and speed gating circuit 66.

Steering follow up variable resistor 64, shown as variable resistor R215, cooperates with a timing capacitor C218, a linearizing transistor Q206 and a switch transistor Q207 to permit the generation of a digital quantity in microprocessor MP201 which is proportional to the position of the wiper of steering follow up variable resistor R215. This analog to digital conversion may function the same as steering A/D converter 40 described in connection with FIG. 9. Consequently, the operation of this part of the circuit will not be described in detail. It is sufficient to understand that, at the proper time, a signal from output BO of microprocessor MP201 turns switch transistor Q207 OFF and the decaying DC signal from timing capacitor C218 applied to terminal A3 of microprocessor MP201 is used to generate a digital number representative of the position of steering follow up variable resistor R215. When a properly decodable steering command is received at terminal A1 of microprocessor MP201, the number representing the command is compared to the number representing the position of steering follow up resistor R215 to determine the difference, or error, therebetween. This error is employed to produce a pulse width modulated signal on output B1 or B2 depending on whether the steering error is the left or right direction. The pulse width of the single resulting output signal is variable in dependence on the magnitude of the error. If there is no error, a brake signal appears at output B6 of microprocessor MP201. The brake signal causes the steering system to resist motion in either direction. The steer right, steer left and brake signal from outputs B1, B2 and B6 are applied to steering gating circuit 58.

Steering gating circuit 58 is identical to speed gating circuit 66 and, except for a minor difference to be described, steering drive circuit 60 is identical to speed drive circuit 68. Consequently, only steering gating circuit 58 and steering drive circuit 60 are described in detail.

Steering gating circuit 58 is provided to prevent inadvertent driving of steering drive motor 62 simultaneously in opposite directions. This could happen since, immediately after being turned ON, microprocessor MP201 provides 0 volts on all of its outputs until circuit operation stabilizes. Since 0 volts is accepted by steering drive circuit 60 as a driving command, 0 volts on microprocessor MP201 outputs B1 and B2 would produce oppositely directed drive and result in excessive power consumption and wear in steering motor 62.

Steering gating circuit 58 contains two NAND gates A204 and A205 as well as two OR gates A208 and A209. The braking output from terminal B6 of microprocessor MP201 is connected to one input of each of NAND gates A204 and A205. The output of NAND gates A204 and A205 are connected respectively to inputs of OR gates A208 and A209. Output B1 of microprocessor MP201 is connected to a second input of NAND gate A204 and to a second input of OR gate A209. Similarly, output B2 of microprocessor MP201 is connected to a second input of NAND gate A205 and OR gate A208.

Table 2 contains a truth table for steering gating circuit 58 showing the condition of the brake signal to transistors Q208 and Q209 and to steer left transistor Q218 and steer right transistor Q219.

TABLE 2

STEERING GATING CIRCUIT 58 TRUTH TABLE

| B6 | B2 | B1 | Brake To Q208 and Q209 | To Q218 | To Q219 |
|---|---|---|---|---|---|
| 0 | 0 | 0 | 0 | 1 | 1 |
| 0 | 0 | 1 | 0 | 1 | 1 |
| 0 | 1 | 0 | 0 | 1 | 1 |
| 0 | 1 | 1 | 0 | 1 | 1 |
| 1 | 0 | 0 | 1 | 1 | 1 |
| 1 | 0 | 1 | 1 | 1 | 0 |
| 1 | 1 | 0 | 1 | 0 | 1 |
| 1 | 1 | 1 | 1 | 1 | 1 |

"0" ≈ zero volts, "1" ≈ 5 volts

It will be noted that whenever a brake signal appears at output B6 of microprocessor MP201, the two outputs of steering gating circuit 58 are always "1" (nominally five volts). Whenever outputs B1 and B2 are the same, either both "0" or both "1", the outputs from steering gating circuit 58 are always both "1". When outputs B6 and B1 are both "1" and output B2 is "0", then, and only then, is an output to transistor Q219 "0". Similarly, only when outputs B6 and B2 are "1" and output B1 is "0" is the output from steering gating circuit 58 to transistor Q218 "0". Thus steering gating circuit 58 acts as an exclusive OR circuit with negative logic preventing simultaneous energization of steering in opposite directions.

Transistors Q208 through Q211 operate in pairs to steer left, steer right or brake. A "0" output from OR gate 208 turns ON transistor Q219 which turns ON transistors Q209 and Q210 to apply positive voltage ++V through transitors Q209 to the right input terminal of steering motor 62 and ground through transistor Q210 to the left input terminal of steering drive motor 62 as seen in FIG. 14A. Similarly, a "0" output from OR gate A209 turns transistor Q218 ON and makes transistors Q208 and Q211 conductive. This places positive voltage on the left terminal of steering motor 62 through transistor Q208 and ground on the right terminal of steering motor 62 as seen in FIG. 14A. In this fashion, steering motor 62 is selectively driven in either direction. When a brake signal appears at terminal B6 of microprocessor MP201 it is applied through resistors R219 and R220 to the bases of transistors Q208 and Q209. This makes transistors Q208 and Q209 conductive and places voltage ++V at both sides of motor 62. This produces dynamic braking in steering motor 62 and tends to damp out mechanical resonances of the steering system as the steering error signal passes through zero.

Speed drive circuit 68 is identical to steering drive circuit 60 except for the provision of two parallel pairs of transistors Q212, Q213 and Q216, Q217 for driving speed drive motor 70 in the forward direction. The provision of pairs of transistors accommodates the high current requirements normally placed on a drive circuit for driving the vehicle in the forward direction. Reverse drive transistors Q214 and Q215 are shown as single transistors since reverse operation is normally done less frequently and more slowly. Alternatively, transistors Q214 and Q215 may also be replaced by parallel pairs of transistors in order to accommodate higher current. Diodes D204–D211, capacitors C219–C222 as well as motor shielding and grounding are employed to reduce electrical noise from operation of the DC steering motor 62 and speed drive motor 70.

The following list of parts provides identification and values of parts used in one embodiment reduced to practice. One skilled in the art would readily be capable of modifying values and changing the selection of parts to achieve comparable results.

| TRANSISTORS | | DIODES | |
|---|---|---|---|
| Q101 | MPS918 | D101 | IN5232 |
| Q102 | MPS918 | D201 | IN5232 |
| Q103 | MPS6560 | D202 | IN4148 |
| Q105 | MPS6560 | D203 | IN4148 |
| Q106 | MPS6560 | D204 | IN4001 |
| Q107 | MPS6560 | D205 | IN4001 |
| Q108 | MPS6560 | D206 | IN4001 |
| Q109 | MPS6560 | D207 | IN4001 |
| Q201 | MPS6560 | D208 | IN4001 |
| Q206 | MPS6560 | D209 | IN4001 |
| Q207 | MPS6560 | D210 | IN4001 |
| Q208 | PNP | D211 | IN4001 |
| Q209 | PNP | D212 | IN4148 |
| Q210 | MPS6560 | D213 | IN4148 |
| Q211 | MPS6560 | D301 | IN4729 |
| Q212 | S43626 | D302 | IN3064 |
| Q213 | S43626 | D303 | IN3064 |
| Q214 | S43626 | D304 | IN3064 |
| Q215 | S43625 | D305 | IN3064 |
| Q216 | S43625 | | |
| Q217 | S43625 | | |
| Q218 | PNP | | |
| Q219 | PNP | | |
| Q220 | PNP | | |
| Q221 | PNP | | |
| Q301 | 2N918 | | |

-continued

| | |
|---|---|
| Q302 | MPS6560 |
| Q303 | MPS6560 |
| Q304 | SPRAGUE |
| Q305 | SPRAGUE |
| Q306 | SPRAGUE |
| Q307 | SPRAGUE |
| Q308 | SPRAGUE |
| Q309 | 2N4249 |
| Q310 | CS9018 |

MISCELLANEOUS

| | |
|---|---|
| MP101 | G1655 MICROPROCESSOR |
| MP201 | G1655 MICROPROCESSOR |
| A201 | 4011AE NAND GATE |
| A202 | 4011AE NAND GATE |
| A203 | 4011AE NAND GATE |
| A204 | 4011BE NAND GATE |
| A205 | 4011BE NAND GATE |
| A206 | 4011BE NAND GATE |
| A207 | 4011BE NAND GATE |
| A208 | 4071 OR GATE |
| A209 | 4071 OR GATE |
| A210 | 4071 OR GATE |
| A211 | 4071 OR GATE |
| X101 | 24.93 MHz crystal |

| RESISTORS | | CAPACITORS (Microfarad unless otherwise marked) | |
|---|---|---|---|
| R101 | 10K | | |
| R102 | 2.2K | | |
| R103 | 390 | | |
| R104 | 10K | C101 | .01 |
| R105 | 10K | C102 | .001 |
| R106 | 10 | C104 | 4.7 pf |
| R107 | 10K | C105 | 68 pf |
| R108 | 10K | C107 | 560 pf |
| R109 | 250K variable | C108 | .01 |
| R110 | 250K variable | C109 | .0068 |
| R111 | 250K variable | C110 | .0033 |
| R112 | 10K | C111 | 47 pf |
| R113 | 10K | C112 | .1 |
| R114 | 100K | C201 | 22 |
| R116 | 4.7K | C202 | .01 |
| R117 | 10K | C205 | 2.2 |
| R201 | 470 | C210 | .1 |
| R203 | 100K variable | C211 | 47 pf |
| R205 | 15K | C218 | .01 |
| R209 | 68K | C219 | .1 |
| R210 | 330K | C220 | .1 |
| R214 | 20K variable | C221 | .1 |
| R215 | 100K variable | C222 | 100 |
| R216 | 25K variable | C301 | .01 |
| R217 | 100K | C302 | 470 pf |
| R219 | 4.7K | C303 | 33 pf |
| R220 | 4.7K | C304 | 680 pf |
| R223 | 4.7K | C305 | 2.2 |
| R224 | 4.7K | C306 | 470 pf |
| R226 | 27 | C307 | 3300 pf |
| R227 | 27 | C308 | 3.3 |
| R230 | 27 | C309 | 2 pf |
| R231 | 27 | C310 | 33 pf |
| R234 | 4.7K | C311 | 180 pf |
| R235 | 10K | C312 | 5.6 pf |
| R236 | 10K | | |
| R237 | 10K | | |
| R238 | 10K | | |
| R239 | 10K | | |
| R240 | 10K | | |
| R241 | 10K | | |
| R301 | 3K | | |
| R302 | 4.7K | | |
| R303 | 10K | | |
| R304 | 20K variable | | |
| R305 | 15K | | |
| R306 | 39K | | |
| R307 | 10K | | |
| R308 | 3.3K | | |
| R309 | 560 | | |
| R310 | 4.3K | | |
| R311 | 100 | | |
| R312 | 82K | | |
| R313 | 5.6K | | |
| R314 | 3.3K | | |

-continued

| | |
|---|---|
| R315 | 7.5K |
| R316 | 560 |
| R317 | 100K |
| R318 | 4.7K |
| R319 | 10K |
| R320 | 4.7K |
| R321 | 22K |
| R322 | 270 |
| R323 | 4.7K |

Having described specific preferred embodiments of the invention with reference to the accompanying drawings, it is to be understood that the invention is not limited to those precise embodiments and that various changes and modifications may be effected therein by one skilled in the art without departing from the scope or spirit of the invention as defined in the appended claims.

What is claimed is:

1. In a vehicle radio control system of the type having at least one control set to transmit command signals for commanding the operation of at least two functions of a vehicle, said vehicle including means for receiving the transmitted command signals to derive at least first and second function control signals and a brake control signal therefrom, said first and second function control signals causing first and second opposite functions to be performed and said brake control signal being selectively derived to inhibit either function from being performed; and gating means for gating one and only one function control signal so as to prevent both of said functions from being performed concurrently.

2. In a vehicle radio control system of the type having at least one control set to transmit command signals for commanding the operation of at least two functions of a vehicle, said vehicle including means for receiving the transmitted command signals to derive at least first and second function control signals and a brake control signal therefrom, said first and second function control signals causing first and second opposite functions to be performed and said brake control signal being selectively derived to inhibit either function from being performed; and gating means for gating one and only one function control signal so as to prevent both of said functions from being performed concurrently; said gating means comprises first and second NAND gates and first and second OR gates; said first function control signal and said brake control signal being applied to said first NAND gate, said second function control signal and said brake control signal being applied to said second NAND gate, an output of said first NAND gate and said second function control signal being applied to said first OR gate, and an output of said second NAND gate and said first function control signal being applied to said second OR gate, wherein an output is produced by one and only one of said first and second OR gates to enable a corresponding function to be performed.

3. A toy vehicle radio control system of the type having a plurality of vehicles, each of which is independently radio controlled by a respective one of a plurality of control sets, each control set comprising burst generating means for generating repetitive bursts of successive digital signals separated by quiescent periods that are at least ten times the duration of each burst time duration, each burst of digital signals including a unique digital identity code to identify a corresponding one of said vehicles followed by at least first and second digital command signals to command the execution of first and second functions by said corresponding one vehicle, the bursts generated by said control sets having substantially the same time duration but different repetition frequencies, modulating means for modulating a radio frequency carrier with said repetitive bursts of successive digital signals, and radio transmission means for transmitting the modulated bursts asynchronously with respect to the transmission of modulated bursts by others of said control sets, and each vehicle comprising receiving means for receiving all of the transmitted, modulated bursts, means for demodulating the received bursts, means for detecting the unique digital identity code included within said demodulated burst so as to indicate that the digital command signals included in said demodulated burst are intended to command the execution of said first and second function by said vehicle, decoding means operative only if said unique digital identity code is detected to decode said first and second digital command signals and to produce first and second function control signals corresponding thereto, and first and second operating means responsive to said first and second function control signals for executing said first and second functions in accordance with said commands.

4. A toy vehicle radio control system of the type having a plurality of vehicles, each of which is independently radio controlled by a respective one of a plurality of control sets, each control set comprising burst generating means for generating repetitive bursts of successive digital signals separated by quiescent periods that are at least ten times the duration of each burst time duration, each burst of digital signals including a unique digital identity code to identify a corresponding one of said vehicles followed by at least first and second digital command signals to command the execution of first and second functions by said corresponding one vehicle, each of said digital command signals represents a value of the function to be executed in response thereto, said value being within a predetermined band of a preset range; the bursts generated by said control sets having substantially the same time duration but different repetition frequencies, modulating means for modulating a radio frequency carrier with said repetitive bursts of successive digital signals, and radio transmission means for transmitting the modulated bursts asynchronously with respect to the transmission of modulated bursts by others of said control sets, and each vehicle comprising receiving means for receiving all of the transmitted, modulated bursts, means for demodulating the received bursts, means for detecting the unique digital identity code included within said demodulated burst so as to indicate that the digital command signals included in said demodulated burst are intended to command the execution of said first and second function by said vehicle, decoding means operative only if said unique digital identity code is detected to decode said first and second digital command signals and to produce first and second function control signals corresponding thereto, said decoding means comprises means for sensing if each of the initially transmitted digital command signals differs from a predetermined nominal value thereof, means for deriving an offset signal as a function of the sensed difference, and means for combining said offset signal with all of the subsequently decoded first and second digital command signals, respectively; and first and second operating means responsive to said first and second function control signals for executing said first and second functions in accordance with said commands.

5. A vehicle control system according to claim 3; wherein said quiescent periods of the bursts generated by said respective control sets are relatively prime.

6. A vehicle control system according to claim 3; wherein said at least first and second digital command signals comprise at least a speed command signal and a steering command signal.

7. A vehicle control system according to claim 3; wherein said identity code, and said at least first and second digital command signals are coded in Manchester code.

8. Apparatus for communicating between a plurality of control sets and a plurality of vehicles in a vehicle radio control system of the type in which said plurality of vehicles are independently controlled by said plurality of control sets, respectively, said apparatus comprises:

means in each of said plurality of control sets for generating a pulse-type radio frequency signal;

a receiver in each of said plurality of vehicles for receiving said pulse-type radio frequency signal;

said receiver comprising:

a regenerative stage having a quench frequency;

means for feeding said pulse-type radio frequency signal to said regenerative stage;

means for developing a voltage in proportion to an amplitude of said pulse-type radio frequency signal fed to said regenerative stage;

integrating means including a transistor and a feedback capacitor for integrating said developed voltage to produce an integrated voltage proportional to an average value of said developed voltage;

means for feeding said integrated voltage back to said regenerative stage for controlling said quench frequency thereof; and said integrated voltage being an output of said receiver and having an envelope proportional to an envelope of said pulse-type radio frequency signal.

* * * * *